US008100546B2

(12) United States Patent
Lutz et al.

(10) Patent No.: US 8,100,546 B2
(45) Date of Patent: Jan. 24, 2012

(54) ROTATING FIBER OPTIC SCULPTURE

(76) Inventors: Frank Lutz, Morehead, KY (US); Jon Turan, Weatherford, TX (US)

( * ) Notice: Subject to any disclaimer, the term of this patent is extended or adjusted under 35 U.S.C. 154(b) by 94 days.

(21) Appl. No.: 12/715,158

(22) Filed: Mar. 1, 2010

(65) Prior Publication Data

US 2011/0211364 A1 Sep. 1, 2011

(51) Int. Cl.

| | |
|---|---|
| ***F21V 21/30*** | (2006.01) |
| ***F21V 7/04*** | (2006.01) |
| ***F21V 21/00*** | (2006.01) |
| ***A41G 1/00*** | (2006.01) |
| ***A47G 33/00*** | (2006.01) |
| ***F21S 4/00*** | (2006.01) |
| ***A01N 3/00*** | (2006.01) |
| ***G09F 19/08*** | (2006.01) |

(52) U.S. Cl. ..... 362/35; 362/568; 362/123; 362/249.19; 362/564; 428/18; 40/414; 40/429

(58) Field of Classification Search ..... 362/35, 362/567, 568, 123, 249.18, 249.19, 564; 428/18–20; 40/414, 429–432
See application file for complete search history.

(56) References Cited

U.S. PATENT DOCUMENTS

| | | | | |
|---|---|---|---|---|
| 1,711,790 | A * | 5/1929 | Johnson | 40/473 |
| 3,652,972 | A | 3/1972 | Kreider | |
| 4,249,331 | A * | 2/1981 | Vernon | 40/432 |
| 5,255,886 | A | 10/1993 | Wang | |
| 5,422,797 | A | 6/1995 | Shattan | |
| 5,639,157 | A * | 6/1997 | Yeh | 362/567 |
| 5,647,569 | A | 7/1997 | Sofy | |
| 5,829,863 | A | 11/1998 | Gutshall | |
| 6,431,740 | B1 | 8/2002 | Puleo | |
| 7,052,156 | B2 * | 5/2006 | Primeau | 362/123 |
| 2004/0004828 | A1 * | 1/2004 | Chernick et al. | 362/35 |
| 2007/0253191 | A1 * | 11/2007 | Chin et al. | 362/123 |

* cited by examiner

*Primary Examiner* — Jong-Suk (James) Lee
*Assistant Examiner* — David J Makiya
(74) *Attorney, Agent, or Firm* — Charles D. Gunter, Jr.

(57) ABSTRACT

A sculpted decorative object, such as a Christmas tree, is shown which has a motor driven vertical drive shaft and three rotating sections. Rotation of the vertical drive shaft and an associated drive gear causes relative rotation of a driven gear and, in turn, a respective rotating section of the object about the axis of the drive shaft. A fiber optic bundle is mounted within each rotating section of the object. Each bundle contains several fiber optic strands which terminate at a LED light source at one end and at a light emitting element at an opposite end. Each LED light source is supplied from a common electrical source by means of a series of wiper contacts and rotatable contact rings carried by respective stationary and rotating portions of the sculpted object.

10 Claims, 5 Drawing Sheets

ROTATING FIBER OPTIC SCULPTURE

BACKGROUND OF THE INVENTION

1. Field of the Invention

The present invention relates to electro-mechanical decorative sculptural displays and, more particularly, to a motorized rotating display for a sculptured work such as a Christmas tree which is capable of rotation or counter rotation and is also illuminated by fiber optic light sources.

2. Description of the Prior Art

A wide variety of holiday and other festive ornamental displays exist, including numerous types of Christmas ornamental displays. Many of these displays incorporate music and/or light effects and, in some cases motion. For example, the art is replete with many forms of illumination of artificial Christmas trees. Some of these trees, such as those disclosed in issued U.S. Pat. Nos. 2,227,861, 3,465,139, 3,735,117, 3,035,162 and 2,519,690, disclose systems whereby individual illumination effects are provided at particular locations generally at the ends of branches or throughout the trunk of the tree. Some of these patents show a single illumination source while others contemplate separate illumination of respective bulbs.

Also known in the art are artificial Christmas trees which are illuminated by fiber optic elements. There are many examples of such trees, including for example, those shown in issued U.S. Pat. Nos. 3,564,233, 3,766,376, 4,068,118 and 4,364,102. All of these patents disclose various illumination systems which produce either point sources of light or clusters of light into the tree foliage and require substantial complexity in their construction and assembly.

Small fiber optic Christmas trees having a height generally ranging from 2 feet to 4 feet are well known and commercially available. Such trees include a hollow main stem or trunk and a plurality of branches having simulated tree needles, usually shredded green polyvinyl chloride (PVC), mounted thereon. A plurality of fiber optic strands extend into and along the branches and have terminal ends near the tips of the branches and the needles. The fiber optic strands extend from the branches down through the center of the hollow main stem or trunk. The main stem or trunk is supported on a housing generally in the form of a container or pot having a socket in its upper end telescopically receiving the lower end of the main stem or trunk. A motor driven rotatable color wheel is mounted in the housing or pot and a halogen light is mounted under the color wheel so that the rotating color wheel will illuminate the ends of the fiber optic strands at the lower end of the main stem with different colors. The main stem or trunk must have a diameter sufficient to receive a large number of fiber optic strands which terminate at the lower end of the main stem or trunk.

Various types of holiday and other festive decorative sculptural works as opposed to simulated trees, are also available in the marketplace. These works include various types of ceramic figurines, holiday scenes, and other objects of an almost infinite variety. Certain items of this type have central body portions of the sculptural work which are molded from suitable plastic materials, rather than ceramics. Molded sculpted Christmas Trees, including those illuminated by fiber optic lighting elements are known in the prior art. The known prior art have tended to use the same type of motor driven rotatable color wheel described above with respect to the stem and trunk tree designs, however. The ability to provide an articulated design with, for example, layers or sections of the design which rotate or counter rotate was limited, however, because of the necessity of running the wiring harness for the fiber optic lights from the distal light locations to the color wheel in the base of the device.

The present invention accordingly has as one object to provide a rotating or counter rotating motorized base design for a fiber optic illuminated sculpted object which provides an improved possibility of articulation by means of a novel arrangement of the associated lighting wiring harnesses and electrical contact system as well as the motor drive arrangements.

SUMMARY OF THE INVENTION

The sculpted decorative object of the invention is powered by an electric motor and an associated driven central shaft which extends upwardly from a base compartment along a generally vertical axis. A lower rotating section is mounted on the base compartment. The lower rotating section houses a driven gear mounted in engagement with a drive gear located on the driven central shaft, whereby rotation of the central shaft and its associated drive gear causes relative rotation of the driven gear and, in turn, the lower rotating section about the axis of the central shaft.

At least an intermediate rotating section and an upper rotating section, are also each provided with a driven gear or gears mounted for engagement with a drive gear on the central shaft, whereby rotation of the central shaft causes relative rotation of the intermediate and upper rotating sections. In one preferred form of the invention, the drive gears and driven gears of the lower, intermediate and upper rotating sections are arranged to provide counter rotation between at least two of the respective sections.

A fiber optic bundle is mounted on at least two of the rotating sections, each fiber optic bundle having a plurality of fiber optic strands which terminate at a LED light source at one extent and at light emitting elements at an opposite extent. Each of the LED light sources is supplied from a common electrical source. Preferably, each of the rotating sections has an associated stationary tower section and a rotating collar section. The common electrical source includes a series of electrical wiper contacts located on each of the stationary tower sections which make electrical contact with a set of conductive rings mounted on each of the respective rotating collar sections, whereby rotational movement of the rotating collar section relative to a respective stationary tower causes the conductive rings to contact the wiper contacts and maintain electrical continuity between a power source and the LED light sources. At least selected ones of the rotating sections are provided with a decorative external facade.

In its most preferred form, each of the rotating sections of the object makes up a portion of a decorative external facade in the form of a Christmas tree. The fiber optic bundles on each respective rotating section are tied off in discrete bundles which are independent of one another, the bundles being located on separate rotating sections of the tree and being supplied with electrical power by means of the associated electrical wiper contacts and conductive rings carried by the rotating collars. The LED light sources are LED elements which are preferably capable of changing color. In the preferred arrangement, each rotating section of the Christmas tree is provided with a fiber optic bundle and LED light source, and wherein selected light emitting elements of the fiber optic strands are arranged to point downwardly from each rotating section, whereby the upper rotating section illuminates the intermediate section and the intermediate section illuminates the lower section in use.

A crown ornament can be located above the upper rotating section of the Christmas tree and equipped with one or more LED light emitting elements and associated fiber optic strands. Preferably, at least selected ones of the LED light emitting elements are arranged on the crown ornament so as to point downwardly and illuminate the upper rotating section of the tree. The crown ornament can be, for example, a star.

Additional objects, features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included in the accompanying drawings and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
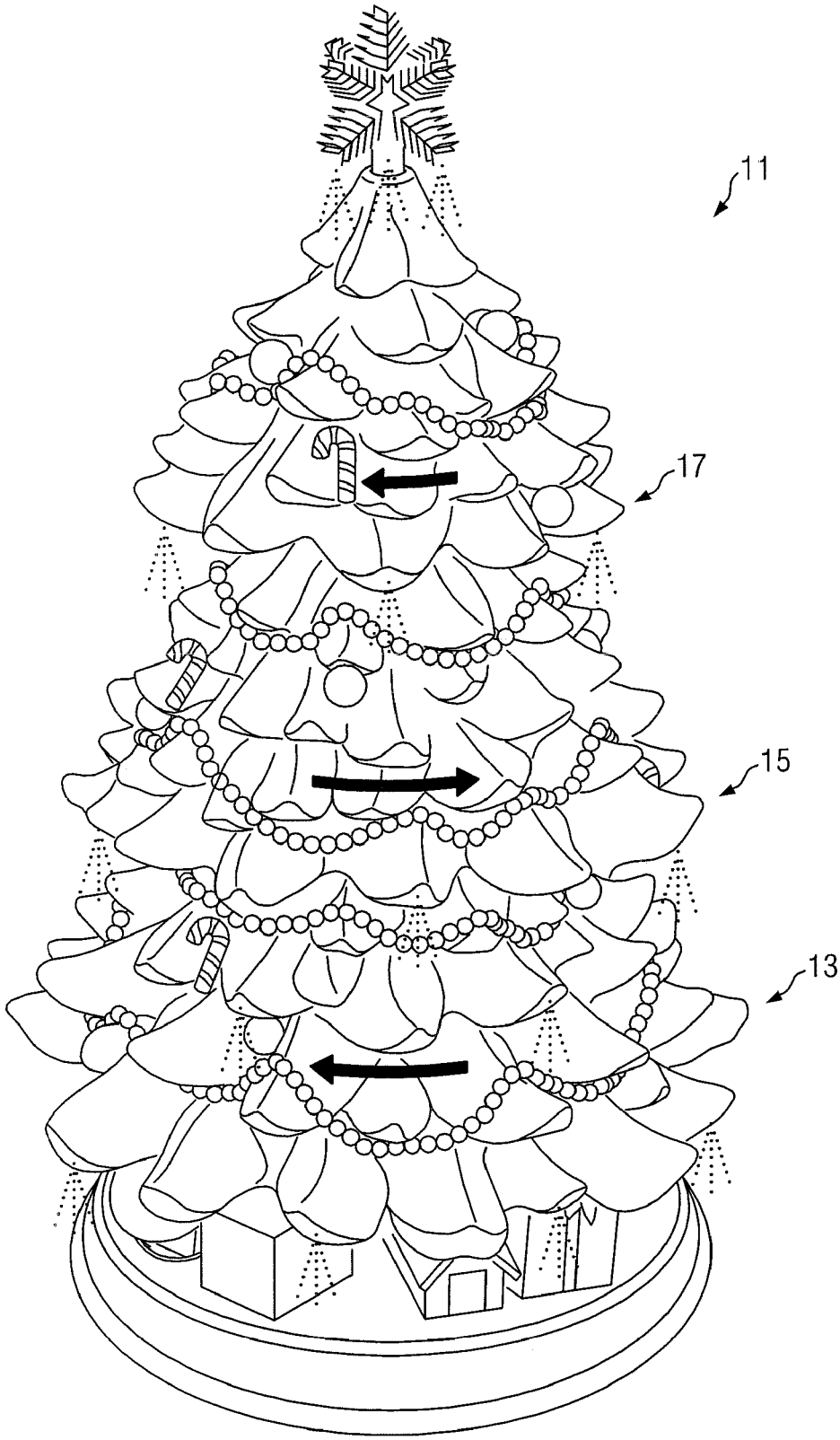
FIG. 1 is a perspective view of a counter-rotating sculpted Christmas Tree of the invention having three rotating sections, the direction of relative counter rotation being indicated by the arrows.
Figure 2:
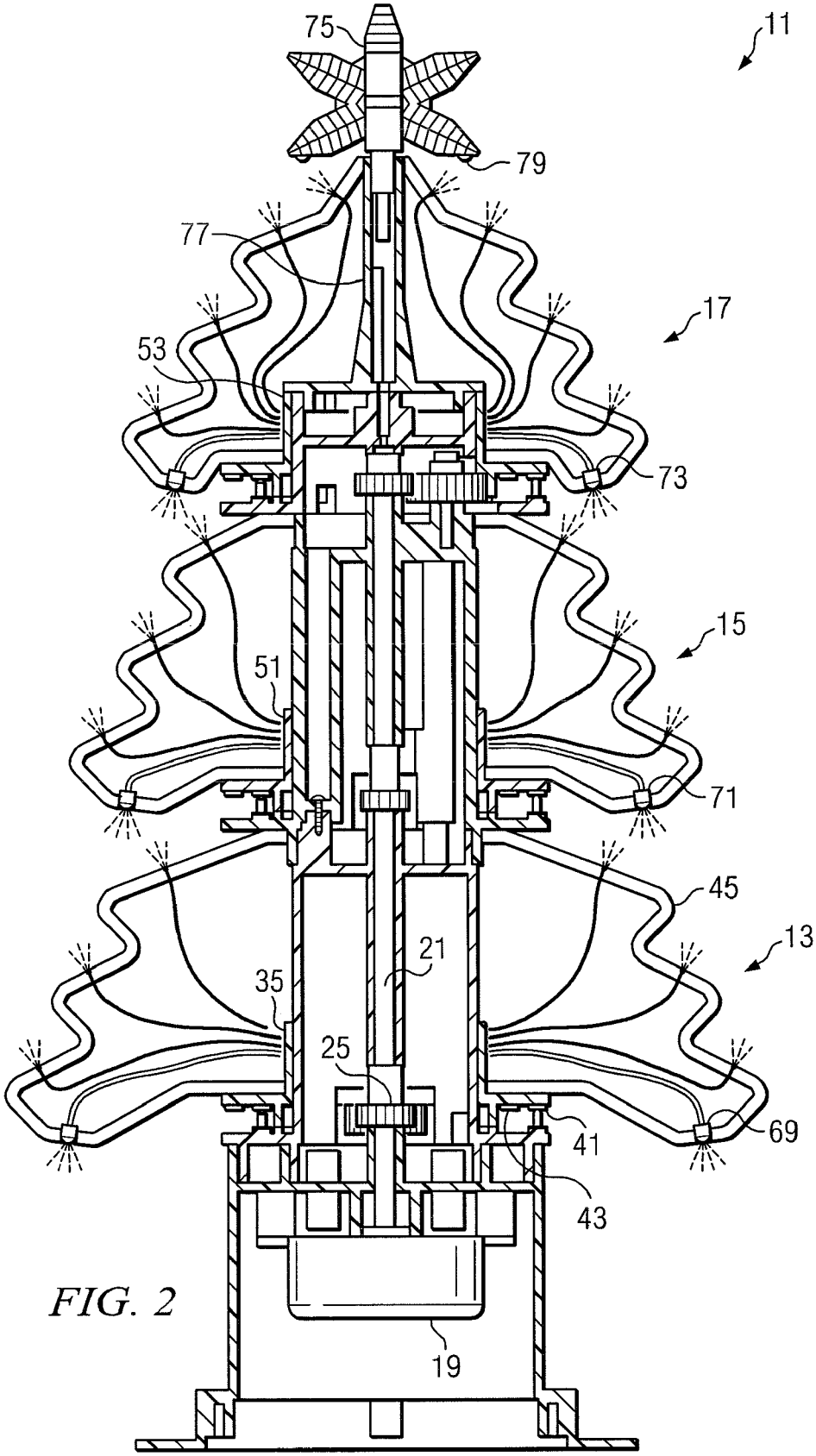
FIG. 2 is a side view of the tree of FIG. 1, partly in section, showing the internal components thereof.

Turning first to FIGS. 1-2, there is illustrated a sculpted decorative object of the invention, designated generally as 11. By "sculpted" decorative object, Applicant intends the general dictionary definition as being an object "created or shaped of stone or wood or other hard material, i.e., a three dimensional work of plastic or ceramic art or the like." As will be apparent from the description which follows, Applicant's preferred sculpted object is a molded plastic or ceramic three dimensional Christmas tree. Applicant is specifically intending to distinguish fiber optic Christmas trees in the prior art which were intended to simulate live trees having tree branches and foliage typically formed of plastic of strips of shredded plastic, metal or foil. Such items will be referred to herein as "trees" whereas Applicant's item is a "sculpted decorative object" or a "sculpted decorative Christmas tree."

As will be apparent from FIGS. 1 and 2, the sculpted decorative Christmas tree of the invention is made up of three rotating sections, designated as 13, 15, 17, which are articulated by means of a motor, shaft and gear drive arrangement, to be more fully described. In the preferred embodiment of the invention, the sections counter rotate. Thus, the intermediate section 15 rotates in a different direction from the lower section 13 and the upper section 17, as indicated by the bold arrows in FIG. 1.

Figure 3:
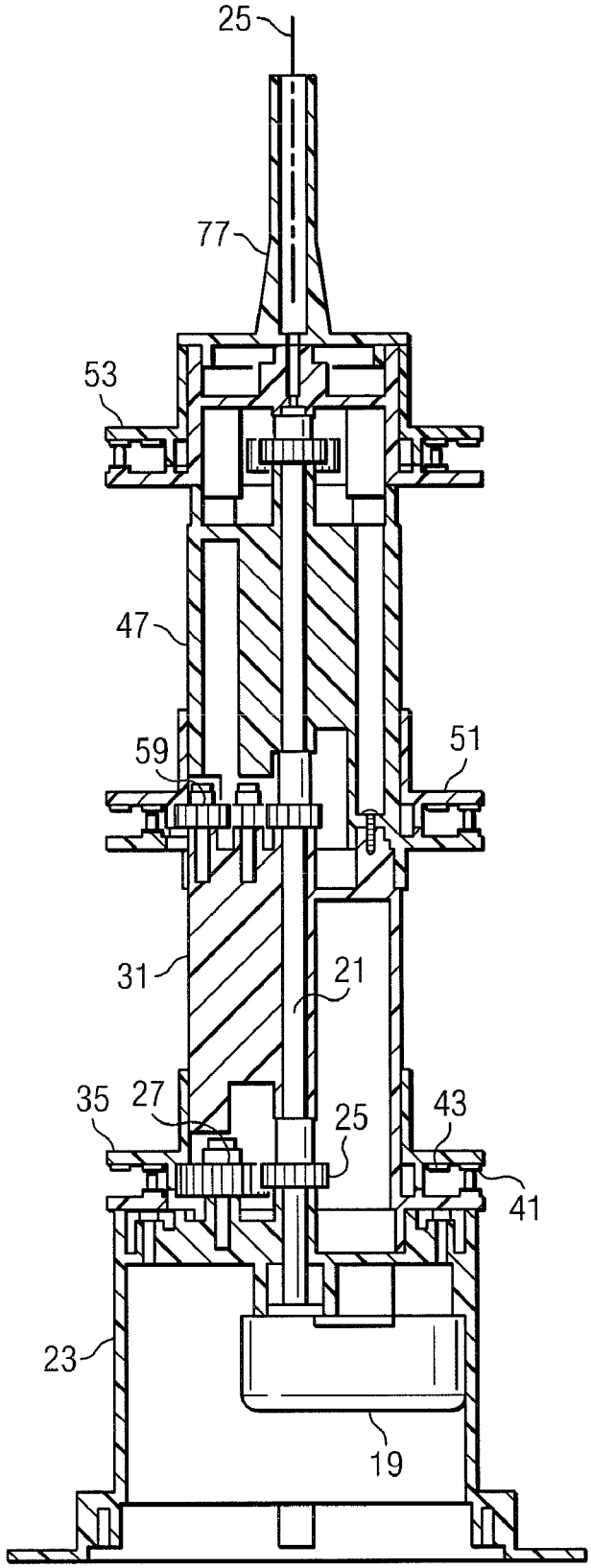
FIG. 3 is a side view, similar to FIG. 2, but of the isolated drive mechanism used in the sculpted tree of the invention.
Figure 4:
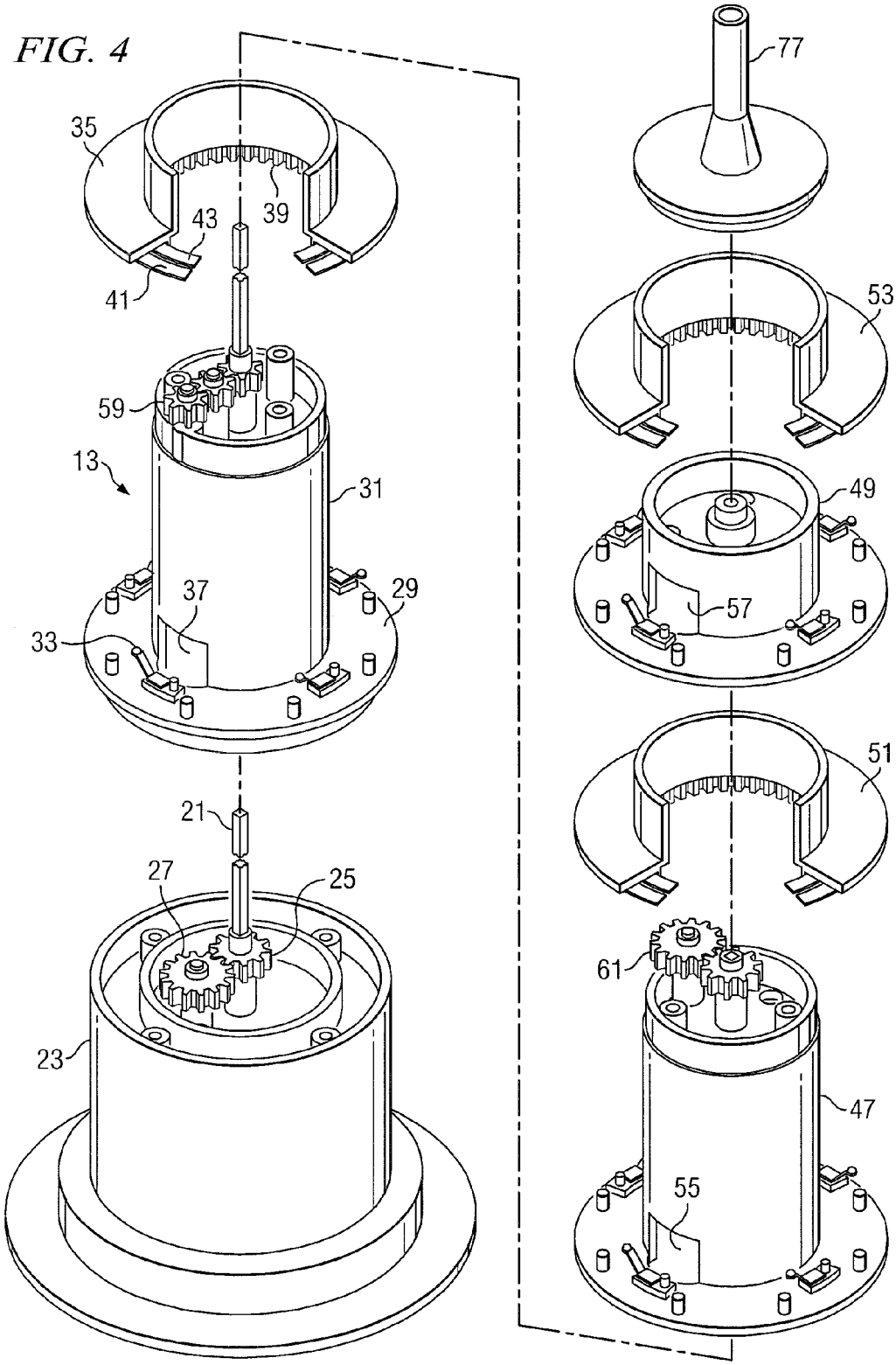
FIG. 4 is an exploded, perspective view of the drive mechanism of FIG. 3.

FIGS. 2-4 illustrate the drive mechanism which is used to rotate the sections 13, 15 and 17. As perhaps best seen in FIGS. 3 and 4, the drive mechanism includes a conventional electric motor 19 and a driven central shaft 21 which extends upwardly from the motor 19 from a location within a base compartment 23 along a generally vertical axis 25. The electric motor 19 can be any conveniently commercially available motor, typically a low-voltage A.C. motor and associated power supply. Such motors are used for a variety of purposes and will be familiar to those skilled in the art. As shown in FIGS. 3 and 4, the electric motor 19 turns the central shaft 21 which carries a drive gear 25. The drive gear 25 meshes with a driven planetary gear 27, whereby, for example, clockwise rotation of the central shaft 21 causes counter clockwise rotation of the driven gear 27.

A lower rotating section 13 is mounted on the base compartment 23. As perhaps best seen in FIG. 4, the lower rotating section 13 has a stationary portion made up of a lower shelf region 29 and an associated tower portion 31 extending vertically upward from the shelf region 29. The shelf region 29 carries a plurality of circumferentially spaced electrical wiper contacts 33. The tower portion 31 and shelf region 29 are fixed relative to the base compartment 23, when the device is assembled. A side opening 37 in a lower region of the tower portion 31 exposes the driven gear 27 of the base. As can be seen in FIG. 4, the rotatable collar 35 has an internal ring gear 39 with teeth which mesh with the driven gear 27 of the base, whereby movement of the driven gear 27 causes relative rotation of the collar 35. The collar 35 also carries a set of conductive rings 41, 43, on a lower surface thereof which make electrical contact with the electrical wiper contacts 33 to thereby provide electrical continuity for the lower rotating section, in use. As will be apparent from FIG. 2, the rotatable collar 35 also carries the outer decorative facade 45.

Returning again to FIG. 4, it will be apparent that each of the remaining intermediate section and upper section of the decorative sculpture of the invention also includes a tower portion (designated as 47 and 49 in FIG. 4), each of which has an associated rotatable collar (51 and 53 in FIG. 4). The side openings 55 and 57 expose the respective driven gears 59 and 61 for engaging the mating teeth provided in the respective rotatable collars 51, 53, respectively, in the same manner as described with respect to the lower rotating section. By providing a two component gear set on the base 23, followed by a three component gear set on the lower tower 31, followed by a two component gear set on the intermediate tower 47, the respective collars 35, 51 and 53 are caused to counter rotate. In other words, if collar 35 rotates in a clockwise direction, collar 51 rotates counter clockwise, while collar 53 again rotates clockwise.

Thus, each of the tower and collar components of the device has an appropriate gear set which includes a driven gear mounted in engagement with a drive gear located on the driven central shaft and one or more driven gears, whereby rotation of the central shaft and its associated drive gear causes relative rotation of the driven gear or gears and, in turn, the respective rotating section about the axis of the central shaft.

Figure 5:
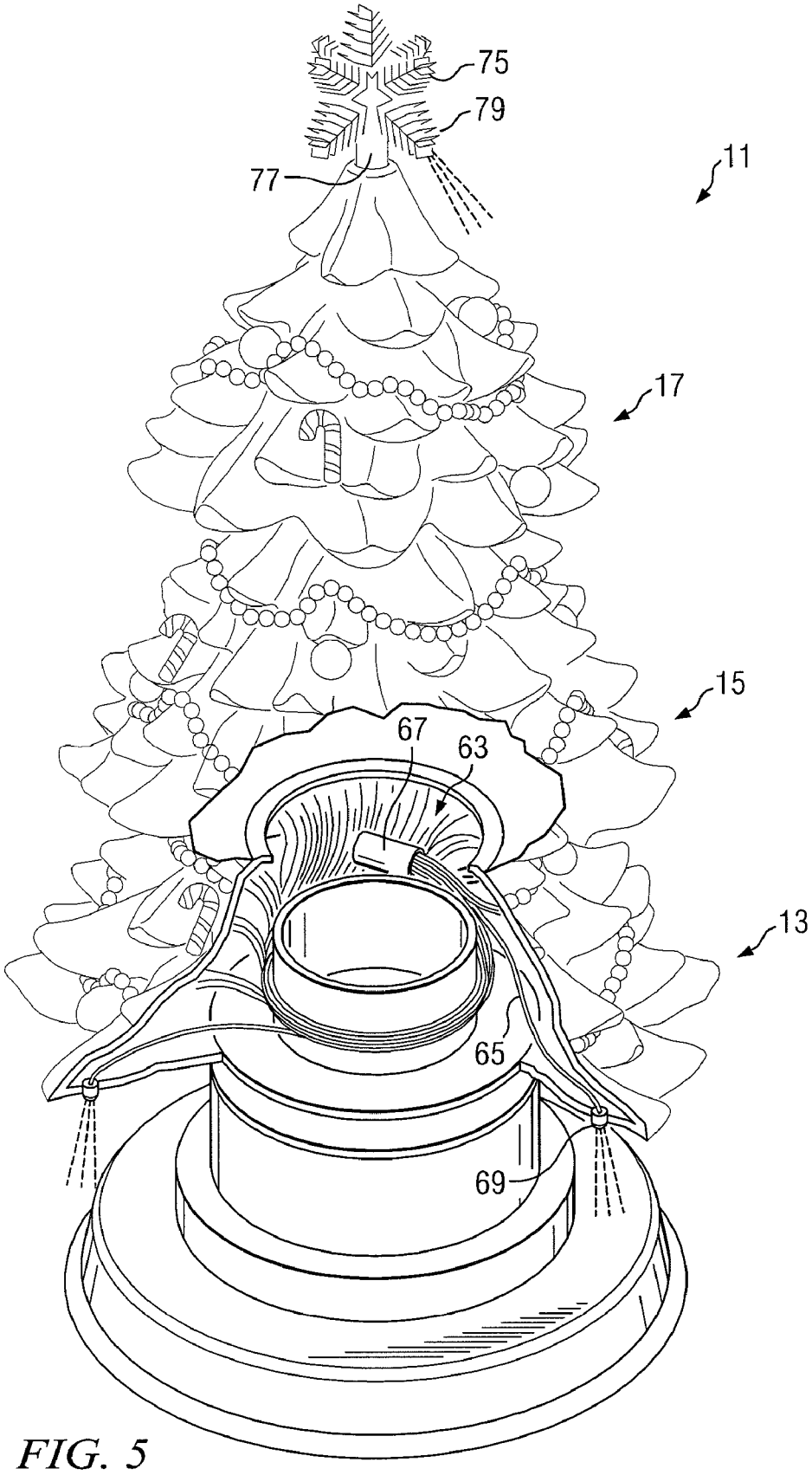
FIG. 5 is a perspective view of the lower section of the sculpted tree of FIG. 1 with portions shown broken away in order to better illustrate the arrangement of the fiber optic wiring harness.

As best shown in FIGS. 2 and 5, a fiber optic bundle is mounted on one or more of the rotating sections, as within an interior space thereof. Preferably, a fiber optic bundle is mounted on each of the three rotating sections 13 , 15, 17. As will be apparent from FIG. 5, each fiber optic bundle (such as bundle 63) is made up of a plurality of fiber optic strands 65, each of which terminates at a LED light source 67 at one extent and at a light emitting element 69 at an opposite extent.

Each of the LED light sources 67 is supplied from a common electrical source. In other words, each of the rotating sections 13, 15, 17, has an associated stationary tower section, as previously described, with a series of electrical wiper contacts (such as contact 33 in FIG. 4) located on each of the stationary tower sections which make electrical contact with the set of conductive rings (41, 43 in FIG. 4) mounted on each of the respective rotating collar sections. In this way, rotational movement of the rotating section relative to a respective stationary tower causes the conductive rings to contact the wiper contacts and maintain electrical continuity between a power source and the LED light sources.

This can be accomplished, for example, by hard wiring the various wiper elements from a source in the base compartment (not shown) with the wires passing up through the interior of the stationary tower portions of the device. The electrical current then passes from the wiper elements to the conductive rings and to the LED light source (such as source 67 in FIG. 5) of the respective fiber optic bundle. Thus, the fiber optic bundles on each respective rotating section are tied off in discrete bundles which are independent of one another, the bundles being located on separate rotating sections of the decorative object.

In the preferred embodiment, the LED light sources are made up of multiple LED elements which are capable of changing color, depending upon which element or elements are energized. Also, another decorative feature of the sculpted tree of the invention relates to the positioning of the light emitting elements of the respective fiber optic bundles. As will be appreciated from FIGS. 2 and 5, selected ones of the light emitting elements of the fiber optic strands (such as elements 69, 71 and 73) are arranged to point downwardly from a lower exposed surface of each rotating section, whereby the upper rotating section illuminates the intermediate section and the intermediate section illuminates the lower section in use. If each section forms the shape of a "skirt," the downwardly pointing light emitting elements are located in the outer periphery of each skirt section, on a lower edge surface thereof.

As shown in FIGS. 2 and 5, a crown ornament 75 sits upon a top cap 77 which, in turn, sits upon the upper rotating section tower 49. The crown ornament, in this case a star, is also equipped with one or more LED light emitting elements (such as element 79 in FIG. 5) and an associated fiber optic strand which can be fed upwardly through the hollow interior of the top cap 77. At least selected ones of the LED light emitting elements 79 are arranged on the crown ornament 75 so as to point downwardly and illuminate the upper rotating section of the sculpted rotating tree.

An invention has been provided with several advantages. The sculpted decorative object of the invention is relatively simple in design and economical to manufacture. The decorative facade of the respective rotating sections can be cast or molded from a suitable plastic, or other conveniently available material. The drive mechanism of the device allows counter rotation of the respective sections, if desired, for a pleasing visual effect. The arrangement of the light emitting elements from the various fiber optic strands is pleasing to the eye and immediately captures the attention of the casual observer. The wiper contacts and rotating conductive rings allow electrical continuity to be maintained between the various sections of the apparatus, even when the sections are separately rotatable.

With respect to the above description then, it is to be realized that the optimum dimensional relationships for the parts of the invention, can include variations in size, materials, shape, form, function and manner of operation, assembly and use, and as such are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A sculpted decorative object, comprising:

a motor and an associated driven central shaft extending upwardly from the motor from a location within base compartment along a generally vertical axis;

a lower rotating section mounted on the base compartment, the lower rotating section housing a driven gear mounted in engagement with a drive gear located on the driven central shaft, whereby rotation of the central shaft and its associated drive gear causes relative rotation of the driven gear and, in turn, the lower rotating section about the axis of the central shaft;

at least an intermediate rotating section and an upper rotating section, each also provided with a driven gear mounted for engagement with a drive gear on the central shaft, whereby rotation of the central shaft causes relative rotation of the intermediate and upper rotating sections;

a fiber optic bundle mounted on at least two of the rotating sections, each fiber optic bundle having a plurality of fiber optic strands which terminate at a LED light source at one extent and at light emitting elements at an opposite extent, each LED light source being supplied from a common electrical source;

wherein each of the rotating sections has an associated stationary tower section and a rotating collar section and wherein the common electrical source includes a series of electrical wiper contacts located on each of the stationary tower sections which make electrical contact with a set of conductive rings carried on each of the respective rotating collar sections, whereby rotational movement of the rotating section relative to a respective stationary tower causes the conductive rings to contact the wiper contacts and maintain electrical continuity between a power source and the LED light sources; and wherein at least selected ones of the rotating sections are provided with a decorative external facade.

2. The sculpted decorative object of claim 1, wherein the drive gears and driven gears of the lower, intermediate and upper rotating sections are arranged to provide counter rotation between at least two of the respective sections.

3. The sculpted decorative object of claim 2, wherein the fiber optic bundles on each respective rotating section are tied off in discrete bundles which are independent of one another, the bundles being located on separate rotating sections of the decorative object.

4. The sculpted decorative object of claim 3, wherein the LED light sources are LED elements which are capable of changing color.

5. The sculpted decorative object of claim 3, wherein each rotating section of the object is provided with a fiber optic bundle and LED light source, and wherein selected light emitting elements of the fiber optic strands are arranged to point downwardly from each rotating section, whereby the upper rotating section illuminates the intermediate section and the intermediate section illuminates the lower section in use.

6. A counter rotating sculpted Christmas tree, comprising:

a motor and an associated driven central shaft extending upwardly from the motor from a location within a base compartment along a generally vertical axis;

a lower rotating section mounted on the base compartment, the lower rotating section housing a driven gear mounted in engagement with a drive gear located on the driven central shaft, whereby rotation of the central shaft and its associated drive gear causes relative rotation of the driven gear and, in turn, the lower rotating section about the axis of the central shaft;

at least an intermediate rotating section and an upper rotating section, each also provided with a driven gear mounted for engagement with a drive gear on the central shaft, whereby rotation of the central shaft causes relative rotation of the intermediate and upper rotating sections, and wherein the drive gears and driven gears of the lower, intermediate and upper rotating sections are arranged to provide counter rotation between at least two of the respective sections;

a fiber optic bundle mounted on each of the three rotating sections, each fiber optic bundle having a plurality of fiber optic strands which terminate at a LED light source at one extent and at light emitting elements at an opposite extent, each LED light source being supplied from a common electrical source;

wherein each of the rotating sections has an associated stationary tower section and a rotating collar section and wherein the common electrical source includes a series of electrical wiper contacts located on each of the stationary tower sections which make electrical contact with a set of conductive rings carried on each of the respective associated rotating collar sections, whereby rotational movement of the rotating collar section relative to a respective stationary tower causes the conductive rings to contact the wiper contacts and maintain electrical continuity between a power source and the LED light sources; and wherein each of the rotating sections makes up a portion of a decorative external facade in the form of a Christmas tree.

7. The counter rotating sculpted Christmas tree of claim 6, wherein the fiber optic bundles on each respective rotating section are tied off in discrete bundles which are independent of one another, the bundles being located on separate rotating sections of the decorative object and being supplied with electrical power by means of the associated electrical wiper contacts and rotating conductive rings.

8. The counter rotating sculpted Christmas tree of claim 7, wherein the LED light sources are LED elements which are capable of changing color.

9. The counter rotating sculpted Christmas tree of claim 8, wherein each rotating section of the Christmas tree is provided with a fiber optic bundle and LED light source, and wherein selected light emitting elements of the fiber optic strands are arranged to point downwardly from each rotating section, whereby the upper rotating section illuminates the intermediate section and the intermediate section illuminates the lower section in use.

10. The counter rotating sculpted Christmas tree of claim 9, wherein a crown ornament sits above the upper rotating section of the Christmas tree and is equipped with one or more LED light emitting elements and associated fiber optic strands, at least selected ones of the LED light emitting elements being arranged on the crown ornament so as to point downwardly and illuminate the upper rotating section of the tree.

* * * * *